United States Patent [19]

Carminati et al.

[11] 3,935,718

[45] Feb. 3, 1976

[54] METHOD FOR MANUFACTURING STOCKINGS, SOCKS AND THE LIKE

[76] Inventors: Amos Carminati, Via Crevatini, 16/A, Muggia (Trieste); Alberto Bienati, Via Matteotti, 23, Trieste, both of Italy

[22] Filed: Nov. 21, 1973

[21] Appl. No.: 418,167

Related U.S. Application Data

[63] Continuation-in-part of Ser. No. 141,902, May 10, 1971, abandoned.

[30] Foreign Application Priority Data

May 14, 1970 Italy ..... 24642/70

[52] U.S. Cl. ..... 66/9 R; 66/14; 66/187

[51] Int. Cl.[2] ..... D04B 9/10; D04B 9/56

[58] Field of Search ..... 66/14, 9 R, 187

[56] References Cited

UNITED STATES PATENTS

| | | | |
|---|---|---|---|
| 3,327,500 | 6/1967 | Currier | 66/187 |
| 3,575,019 | 4/1971 | Janda | 66/187 |
| 3,626,724 | 12/1971 | Wignall et al. | 66/14 |
| 3,626,726 | 12/1971 | Findlay et al. | 66/187 X |
| 3,626,727 | 12/1971 | Wood et al. | 66/187 X |
| 3,768,277 | 10/1973 | Uhlir | 66/14 X |

FOREIGN PATENTS OR APPLICATIONS

| | | | |
|---|---|---|---|
| 1,186,470 | 4/1970 | United Kingdom | 66/187 |

*Primary Examiner*—Wm. Carter Reynolds
*Attorney, Agent, or Firm*—Guido Modiano; Albert Josif

[57] ABSTRACT

A method for manufacturing stockings, socks and the like and closing the toe thereof on a double cylinder knitting machine, comprising the steps of manufacturing a leg, heel and foot portion by selecting the needles to knit in both needle cylinders in a manner to make the reverse fabric side on the exterior as discharged from the machine, operating a 1:1 selection of the needles, lowering a first group of selected needles in the lower needle cylinder and inactivating these needles in the lower cylinder, knitting the toe with the needles which have been transferred to the upper needle cylinder thereby providing an additional pocket around which non knitted thread is wound and interknitting the final part of the additional pocket with the initial part thereof and with the foot portion of the stocking.

1 Claim, 5 Drawing Figures

METHOD FOR MANUFACTURING STOCKINGS, SOCKS AND THE LIKE

CROSS-REFERENCES TO RELATED APPLICATIONS

This is a continuation-in-part of our application Ser. No. 141,902, filed on May 10, 1971, now abandoned.

BACKGROUND OF THE INVENTION

This invention relates to a method for manufacturing stockings, socks and the like and closing the toe thereof, on knitting machines of the type with two needle cylinders.

As is well known, many tubular knitted socks or stockings, both for men and women, especially if made of cotton or analogous yarns and according to various designs, are generally manufactured on circular knitting machines with two cylinders comprising an upper and a lower needle cylinder, in which needles hooked at their two ends may work and slide from one cylinder to the other. From such machines, the stockings or socks, come out with the toe part still open which then requires successive closure operations by means of sewing or linking which notably increase the final manufacturing cost of the socks or stockings.

Furthermore in such machines, the socks or stockings are manufactured so as to follow one after the other with the interpositioning of a waste length of fabric which has to be eliminated by a successive operation with consequent further increase of the cost.

Methods and processes to carry out the closure of the toe parts of stockings or socks directly on circular knitting machines have been suggested as for inst. in U.S. Pat. No. 3,340,706. Such methods are applicable on circular knitting machines with only one needle cylinder.

More particularly, it is well known that knitting machines with one cylinder only include a dial, on which a plurality of hook elements may slide radially, a purpose of which is to hook and to hold yarns or loops of a course of the fabric, especially when reinforced zones have to be formed. It has been already suggested to use the said hooks of the dial for carrying out the toe closure on a single cylinder knitting machine. In this case, assuming that the toe portion of the stocking is made as the last part, a selection of the needles is effected in order to bring a group of needles, for instance alternate needles, in an inoperative position in the needle cylinder in which they limit themselves to the holding of a relative loop of fabric while the hook elements arranged in correspondence of the said needles above them are pushed to project from the dial and hold the yarn, starting from which the remaining needles, which continue to work, knit a new fabric portion. Thus an additional fabric is manufactured, which is held at one side thereof by the needles in inoperative position and at the other side by the hook elements, which additional fabric has the form of an annular pocket. The knitting of this pocket is continued until it has reached a sufficient length to be centrally bound by a further yarn which thus tightens the pocket in correspondence of the axis of the needle cylinder. The two peripheral courses of the pocket, which were held by the hook elements and the inoperative needles, respectively, are then interknitted, thus forming a double layered toe portion directly closed on the machine.

It has been furthermore proposed to transfer this working principle to double cylinder knitting machines, by suggesting that the role of the hook elements, as holding means for some loops, may be taken over by needles arranged in the upper needle cylinder.

A method has therefore been suggested according to which the stocking is manufactured from top portion to toe portion, the leg and foot portion being manufactured with the needles in the lower needle cylinder. The toe portion is manufactured by effecting a selection of the needles, raising a first group thereof to the upper needle cylinder where they assume an inoperative position and retain relative loops of the fabric already knitted, and leaving the remaining needles in the lower needle cylinder. The toe portion is then continued by knitting with the needles remained in the lower needle cylinder, thus forming a pocket similar to that already described above. After the pocket has reached the desired length there occurs a central binding of the pocket and then the needles brought to the upper needle cylinder are lowered to the lower needle cylinder and all the needles are made operative and interknit the final portion of the pocket and the initial portion thereof. The method further comprises the formation of a tab portion having anti-ravelling purposes, this tab being necessary when the stocking is commenced at the leg portion and terminated at the toe.

The said method, which directly derives from adapting the method known on single cylinder knitting machines to a double cylinder knitting machine, requires that the fabric, which is manufactured by the needles in the lower needle cylinder, is taken up through the upper needle cylinder otherwise it would not be possible to make the pocket and close it. Additional means have, therefore, to be arranged on the top of the upper needle cylinder for pulling the fabric. The said means increase the height of the double cylinder knitting machine and entail that a novel machine is designed for carrying out the method. It would appear that a reversion of the operative steps, that is knitting the leg and foot portions on the upper needle cylinder and take up the fabric through the lower needle cylinder, would avoid these drawbacks. Such an operation, however, would require additional operation to be carried out on the stocking since the stocking would require turning inside out when finished.

SUMMARY OF THE INVENTION

It is an object of the invention to provide a method for the toe closure on a double cylinder knitting machine which can be carried out on a conventional double cylinder knitting machine without requiring additional modifications thereof.

According to the invention there is provided a method for manufacturing stockings, socks and the like and closing the toe thereof on a circular knitting machine including an upper and lower needle cylinder, wherein the fabric is taken up through the lower needle cylinder, the method comprising the following steps: knitting the leg and foot portion of the fabric on the needles of both needle cylinders by selecting the needles in a manner such that the areas of said portions having right stitches on the outside of the finished fabric are manufactured with reverse stitches and vice versa; effecting a 1:1 selection of the needles for manufacturing the toe, thereby dividing the needles in first and second needles; lowering the first needles in said lower needle cylinder in an inoperative position, where they retain relative loops of the fabric already knitted; raising said second needles to said upper needle cylinder and continuing to knit with said second needles forming a pocket-shaped fabric portion; stopping the knitting with said second needles when said pocket-shaped fabric portion has a length of substantially twice the radius of said needle cylinders, the bottom of said pocket-shaped fabric being directed towards the axis of said needle cylinders; continuing to revolve the needle cylinders, thereby effecting a binding around said bottom by means of the yarn fed to the knitting point winding itself around said bottom; and bringing all the needles in operative position, whereby the final part of said pocket-shaped fabric portion is interknitted with the initial part thereof and with said foot portion of the fabric.

BRIEF DESCRIPTION OF THE DRAWING

The invention will now be better described with reference to the accompanying drawing in which.

DESCRIPTION OF THE PREFERRED EMBODIMENT

Figures 1, 2, 3, 4, 5:
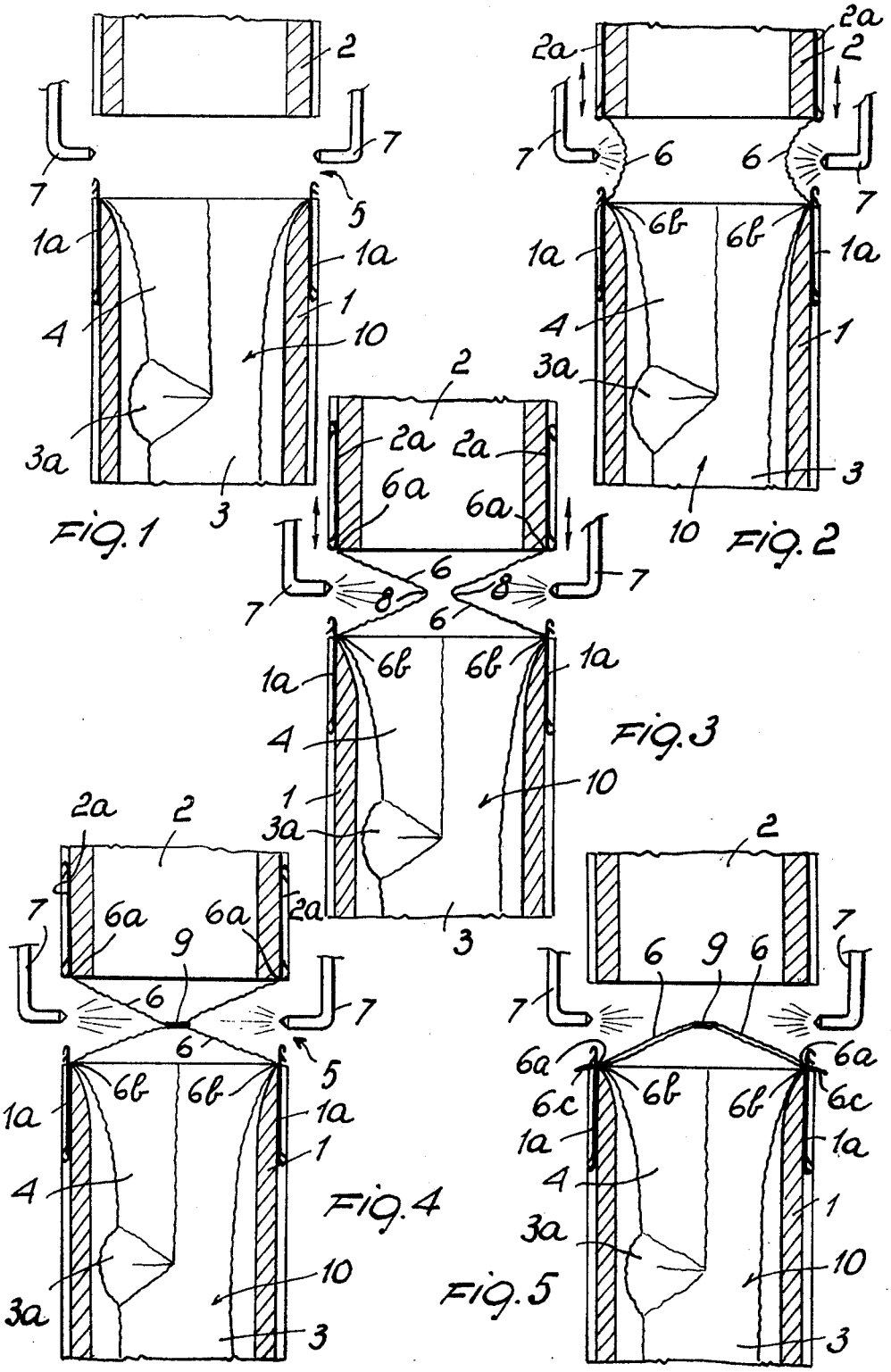
FIG. 1 shows a schematic view of the cylinders of the machine with the sock or stocking manufactured up to the finishing of the foot portion.
FIG. 2 shows a schematic view of the two cylinders with a length of an additional fabric or pocket used for the formation of the toe portion, while the same is made.
FIG. 3 is a similar to the preceding figures, in which the additional length of fabric is completed.
FIG. 4 shows a schematic view in which the closure provided at the median zone of the additional section of fabric, is seen.
FIG. 5 shows a schematic view of the two cylinders of the machine in which the toe of the sock or stocking has been completely closed.

Referring now more particularly to the drawing, the method avails itself of a knitting machine having a lower needle cylinder 1 and an upper needle cylinder 2 on which a tubular leg portion 3 and a sole and foot portion 4 are knitted. The cylinders are spaced apart from each other by the space 5. It is well known that in such conventional machines, needles are working which have an upper and a lower operative head (comprising inter alia the hooked part), which needles may be shifted from the lower cylinder to the upper one, and vice versa, according to the working requirement. The fabric 10 is knitted starting from the leg portion 3 and ending at the toe and it is taken up through the lower needle cylinder 1. According to the invention the leg portion 3 and the foot portion 4 are knitted on the needles in both needle cylinders by selecting the needles to make them to selectively work in the upper and the needle cylinder, the selection being not the conventional one. As it is known, when the needles are in the upper needle cylinder and work with their lower hooked ends they make reverse stitches on the fabric, seen from the outside, and when working in the lower needle cylinder they operate with their upper hooked ends and make right stitches. Now, provided that a preestablished pattern has to be reproduced on the fabric, for instance the common ribbed pattern on the leg and foot portion, some areas have to be knitted with right stitches and some areas with reverse stitches, in order that the finished fabric having the right side out has the pattern correctly knitted on the outside. According to the invention the selection of the needles to work in the upper or the lower needle cylinder and vice versa is made opposite to the selection which would be the conventional one for reproducing the same pattern. This means that the areas with right stitches on the finished fabric are knitted on needles in the upper needle cylinder as reverse stitches and the areas having reverse stitches on the outside of the finished fabric are knitted on needles in the lower needle cylinder as right stitches. The heel 3*a* is knitted with the needles in the lower needle cylinder. To provide this opposite selection the pattern drum which controls this selection is, of course, correspondingly preset and the areas which should be provided with control pins or the like by conventional programming for obtaining the preestablished pattern are empty and those which should be without pins by conventional programming for obtaining the preestablished pattern are instead provided with said pins or the like. The programming of the pattern down therefore occurs in reverse form. It is evident that, if no pattern has to be reproduced on the stocking, the said leg and foot portions are made working with the needles in the upper needle cylinder, so that the stocking is made with the reverse side on the exterior. When the leg portion 3, the heel portion 3*a* and the foot portion 4 have been manufactured, as visible in FIG. 1, a 1:1 selection of the needles occurs. One group of the needles will be called "first" needles 1*a* and the remaining group will be called "second" needles 2*a*. The first needles are all brought in the lower needle cylinder and the second needles are all brought in the upper needle cylinder with the loops thereon.

At this point, the first needles 1*a* are lowererd, in the lower cylinder 1, up to an inoperative position, where they retain the respective loops such needles were holding. The second needles 2*a* knit in the upper needle cylinder, forming an initial part of a pocket shaped fabric portion 6, and then knitting an intermediate part and a final part of this pocket shaped fabric portion, while said enitial part is held by the first needles 1*a*. To the formation of this pocket shaped fabric portion 6, an air jet substantially contributes, this jet being blown substantially radially to the needle cylinders by the nozzles 7 conventionally connected to a compressed air source: as a consequence, the additional fabric 6 is correctly and simmetrically bent with the bottom of the pocket-shape progressively closer to the vertical axis of the cylinders 1 and 2 at substantially the same distance therefrom. When the additional fabric reaches a length which is approximately equal to two times the radius of the cylinders, the bottom 8 of the pocket-shape is substantially concentrated in the zone of the axis of said cylinders.

At this point, all the needles 2*a* are brought, by conventional selection means, in an inoperative position: since the cylinders continue in their rotation, the yarn, which has been fed heretofore tends to wind around the bottom of said pocket, forming a plurality of turns 9, by which the toe of the stocking 10 is bound. It is convenient to subject, in a conventional manner, to a certain stretch the yarn during this winding operation, so that the toe becomes tightly bound.

When this winding is ended, the needles 1*a* which were inoperative in the lower needle cylinder 1 are brought in an operative position, and the needles 2*a* which have knitted the pocket 6 on the upper needle cylinder 2 are transferred into the lower needle cylinder 1 and some courses of knitting are formed, by which the terminal portion 6*a* of the additional fabric 6 is interknitted now with the portion 6*b* of the fabric and with the foot portion 4, which has been kept in abeyance by the first needles 1*a* during their innoperative stage. The toe of the stocking 10 is now definitely closed.

It has been found to be very important to knit an additional tab 6*c* for preventing runs from starting from the last course of fabric. It may be advisable to use an elasticized yarn for this purpose, whereby any type of yarn, even partially made of an elastic material is meant. The said tab is knitted by the needles which are now all in the lower needle cylinder.

The stocking or sock is now terminated and is discharged from the machine through the lower needle cylinder 1.

Since at this point all the needles are already prepared for normal operation, a new stocking or sock can be immediately begun without a length of waste being formed between one stocking or sock and another.

As it appears from the above, the stocking, sock or the like is discharged from the machine having its rear or reverse face on the exterior. More particularly, the leg and the foot portions have the reverse side out while the heel, which is manufactured conventionally with the needles in the lower needle cylinder, has its right side out. The pocket 6, which has been manufactured with the needles in the upper needle cylinder and interknitted at its peripheral courses with the foot portion 4, has both the outer and inner face as right sides. The tab 6*c* projects from the reverse side of the fabric.

Having the socking the reverse side out, a single reversing is required which can be made during the checking of the stocking which always occurs and which involves, when carried out on conventional devices, the reversing of the stocking when the latter is removed from the device. Further operations on the stocking such as sewing or the like can be made before reversing and on the reverse side, so that they are practically not visible from the outside of the finished stocking. Due to the reversing operation the tab remains in the inside or reverse side of the finished stocking and it is not visible. No additional means are required for taking up the fabric through the machine and the method can advantageously be carried out on conventional double cylinder knitting machines. The manufacturing of the leg and foot portion with the reverse stitches as right stitches and vice versa is only a matter of programming the needles to work in the upper or the lower needle cylinder and clearly can be performed with conventional pattern drums. The fact that the heel has its reverse side out once the stocking is reversed does not represent substantial drawback since the said heel occupies a very small portion and is made with plain knit and is practically not notable.

Because of the fact that the method does not requre the construction of novel machines but can be carried out on any conventional double cylinder knitting machine it is very advantageous for series productions usual in this field of manufacturing.

We claim:

1. A method for manufacturing stockings, socks and like fabrics and closing the toe thereof on a circular knitting machine including an upper and a lower needle cylinder, wherein the fabric is taken up through the lower needle cylinder, the method comprising the steps of knitting the leg and foot portion of the fabric on the needles in both needle cylinders by selecting the needles in a manner such that the areas of said portions having right stitches on the outside of the finished fabric are knitted on the needles in the upper needle cylinder as reverse stitches and the areas of said portions having reverse stitches on the outside of the finished fabric are knitted on the needles in the lower needle cylinder as right stitches, the heel being knitted on the needles in the lower needle cylinder; effecting a 1 : 1 selection of the needles for manufacturing the toe, thereby dividing the needles in first and second needles, and bringing the first needles in the lower needle cylinder and the second needles in the upper needle cylinder with the loops thereon; lowering the first needles in said lower needle cylinder in an inoperative position, where they retain relative loops of the fabric already knitted and continuing to knit with said needles in the upper needle cylinder forming an initial part of a pocket-shaped fabric portion, knitting an intermediate part and final part of said pocket shaped fabric portion; stopping the knitting with said second needles when said pocket-shaped fabric portion has a length of substantially twice the radius of said needle cylinders, the bottom of said pocket shaped fabric being directed towards the axis of said needle cylinders; continuing to revolve the needle cylinders, thereby effecting a binding around said bottom by means of the yarn fed to the knitting point winding itself around said bottom; and bringing the second needles into the lower needle cylinder in operative position and knitting with all the needles in the lower needle cylinder, whereby the final part of said pocket-shaped fabric portion is interknitted with the initial part thereof and with said foot portion of the fabric.

* * * * *